US005483020A

United States Patent [19]

Hardie et al.

[11] Patent Number: 5,483,020

[45] Date of Patent: Jan. 9, 1996

[54] TWIN-AX CABLE

[75] Inventors: William G. Hardie; Craig R. Theorin, both of Landenberg, Pa.

[73] Assignee: W. L. Gore & Associates, Inc., Newark, Del.

[21] Appl. No.: 226,747

[22] Filed: Apr. 12, 1994

[51] Int. Cl.[6] ..... H01B 7/34

[52] U.S. Cl. ..... 174/36; 156/51; 156/55; 174/102 R; 174/108; 174/117 F; 174/126.2

[58] Field of Search ..... 174/36, 102 R, 174/108, 126.2, 117 F; 156/50, 51, 55

[56] References Cited

U.S. PATENT DOCUMENTS

| | | | |
|---|---|---|---|
| 1,818,027 | 8/1931 | Affel et al. . | |
| 1,854,255 | 4/1932 | Green . | |
| 2,029,420 | 2/1936 | Green | 178/44 |
| 2,029,421 | 2/1936 | Green | 178/44 |
| 2,034,026 | 3/1936 | Curtis et al. | 178/44 |
| 2,034,033 | 3/1936 | Green et al. | 178/44 |
| 2,034,034 | 3/1936 | Green et al. | 178/44 |
| 2,034,047 | 3/1936 | Leibe et al. | 178/44 |
| 3,105,871 | 10/1963 | Eager, Jr. | 174/105 R |
| 3,358,248 | 12/1967 | Saad | 333/10 |
| 3,425,004 | 1/1969 | Warner | 333/79 |
| 3,673,315 | 6/1972 | Lasley | 174/107 |
| 3,975,473 | 8/1976 | Mulvaney | 264/23 |
| 4,641,111 | 2/1987 | Chapell | 333/115 |
| 4,642,417 | 2/1987 | Ruthrof et al. | 174/36 |
| 4,764,538 | 8/1988 | Buckmaster et al. | 521/85 |
| 4,777,324 | 10/1988 | Lee | 174/34 |
| 4,868,585 | 9/1989 | Mettes et al. | 174/36 |
| 4,967,040 | 10/1990 | Viaud et al. | 174/36 |
| 5,023,279 | 6/1991 | Beckmaster et al. | 521/85 |
| 5,032,621 | 7/1991 | Beckmaster et al. | 521/85 |
| 5,283,390 | 2/1994 | Hubis et al. | 174/36 |
| 5,331,206 | 7/1994 | Liron | 307/270 |
| 5,349,133 | 9/1994 | Rogers | 174/36 |

FOREIGN PATENT DOCUMENTS

| | | | |
|---|---|---|---|
| 3012321 | 1/1981 | Germany | 174/36 |
| 999545 | 7/1965 | United Kingdom | 174/36 |

OTHER PUBLICATIONS

Paper—The Bell System Technical Journal, "The Proportioning of Shielded Circuits for Minimum High–Frequency Attenuation," vol. XV, No. 2, Apr. 1936, pp. 248–283.

Literature: High–Performance Parallel Interface; May 1, 1990, pp. 28–30, Computer & Business Equipment Manufacturers Assn.

Drawing: 25 AWG 150 Ohm Low Skew Parallel Pair Type CL2/FT4; Madison Cable Corporation; Date: Jan. 26, 1994.

*Primary Examiner*—Morris H. Nimmo

*Attorney, Agent, or Firm*—David J. Johns; Victor M. Genco, Jr.

[57] ABSTRACT

A twin axial or parallel pair cable for high data rate differential signal transmission with extremely low skew. The cable has first and second plated electrical conductors which extend in substantially parallel relation to one another. Preferably the conductors are surrounded by first and second foamed fluoropolymer insulating dielectrics, respectively. The dielectrics and the conductors are surrounded by a braided metal shield of plated electrical conductors. The dielectrics insulate the conductors from each other and from the shield, and are sufficiently crush resistant to maintain the conductors in substantially parallel relation to one another over the length of the cable. The shield may be covered with an optional jacket.

26 Claims, 2 Drawing Sheets

TWIN-AX CABLE

FIELD OF THE INVENTION

The present invention relates to cables, and, more particularly, to a shielded parallel pair cable.

BACKGROUND OF THE INVENTION

Electrical cables for data transmission are well known. One common cable is a coaxial cable. Coaxial cables generally comprise an electrically conductive wire surrounded by an insulator. The wire and insulator are surrounded by a shield, and the wire, insulator and shield are surrounded by a jacket. Coaxial cables are widely used and best known for cable television signal transmission and ethernet standard communications in local area networks. Coaxial cables can transmit at much higher frequencies than a standard twisted pair wire and, therefore, have a much greater transmission capacity. Coaxial cables provide data transmission at raw data rates of up to 10 Mbps. In addition, coaxial cables have very little distortion, crosstalk or signal loss, and therefore, provide a very reliable medium for data transmission. Other types of cables are also well known, such as twisted pair cables used for telephone signal transmission, and fiber optic cables.

With the proliferation of high-speed, powerful personal computers and the availability of advanced telecommunications equipment, there is a need for cables which are capable of transmitting data at ever faster speeds. Fiber optic cables provide optimum data rate and performance for long distance and high data rate transmissions, since fiber optic cables provide very high data rate transmission with low attenuation and virtually no noise. Fiber optic cables provide data transmission at data rates up to and beyond 1 Gbps. However, despite the increased availability of fiber optic cables, the price of fiber optic cables and transceivers have not dropped to a level where it is always practicable to use. Accordingly, other less expensive cables capable of high speed data transmission are still in demand.

One such cable used for high speed data transmission between two points or devices is a parallel pair or twin axial cable. Parallel pair cable designs provide two separately insulated conductors arranged side by side in parallel relation, the pair being then wrapped in a shield. A common usage of these cables is to interconnect a mainframe computer to a memory device. As is well known, the speed and data rate with which the computer must communicate with the memory is critical to the computer's performance capabilities.

Parallel pair cables are often used for differential signal transmission. In differential signal transmission, two conductors are used for each data signal transmitted and the information conveyed is represented as the difference in voltage between the two conductors. The data is represented by polarity reversals on the wire pair, unlike a coaxial cable where data is represented by the polarity of the center conductor with respect to ground. Thus, the amplitude of the ground potential on a shielded pair cable is not significant as long as it is not so high as to cause electrical breakdown in the receiver circuitry. The receiver only needs to determine whether the relative voltage between the two conductors is that appropriate to a logical 0 or 1. Accordingly, differential signal transmission provides a better signal-to-noise ratio than voltage level to ground signal transmission (also called single-ended transmission) because the signal voltage level is effectively doubled by transmitting the signal simultaneously over the conductors, with one conductor transmitting the signal 180 degrees out of phase. Differential signal transmission provides a balanced signal which is relatively immune to noise and cross-talk. Interfering signals (or "noise") are generally voltages relative to ground and will affect both conductors equally. Since the receiver takes the difference between the two received voltages, the noise components added to the transmitted signal (on each wire) are negated. This noise is called common-mode noise, and the differential property of the receiver which negates the effect of this noise is known as common mode noise rejection. A standard for differential transmission systems is EIA standard RS-422.

As previously stated, parallel pair cable designs provide two separately insulated conductors arranged side by side in parallel relation, the pair being then wrapped in a shield. Most of the known parallel pair cable designs use a foil shield and include a third drain wire placed beside the parallel conductors. The two insulated conductors and the drain wire are then collectively shielded, often by being wrapped within a layer of aluminized polyester, and then the polyester layer is wrapped with an insulative and protective outer jacket layer, typically of polyvinylchloride (PVC).

In order to transmit the differential signal along a twin-axial cable effectively, the signals on each conductor must propagate down the wire with very low skew. The amount of differential skew per unit length that is allowable is inversely proportional to both the distance of the cable and the data rate at which signal is transmitted. For example, when transmitting at a data rate of 1000 Mbps, the bit width is approximately 1000 psec wide. If the difference between the two signals on the differential cable is greater than 200 psec, errors in communication may occur. If the differential signal is being transmitted 30 meters, then the safe maximum skew would be less than 7 psec/meter.

Unfortunately, for most existing twin-ax cables, typical differential skew is about 16–32 pSec/meter. This type of skew level limits the use-length of 1000 Mbps data transmission to less than 6 meters. As is discussed above, this significantly exceeds the safe level of skew for greater cable lengths. Accordingly, existing twin-axial cables are restricted in their ability to effectively transmit differential signals at a high data rate over an extended length.

Low differential skew is also required for proper cancellation of noise. If signals arrive at the receiver at different times, any coupled noise will not be able to cancel, defeating the primary purpose of a twin-ax cable. The present constraints on managing differential skew in conventional copper twin-ax cables severely limits the use of differential signal transmission in more demanding applications. Accordingly, many designers have been forced to switch to far more expensive fiber optic technology for long distance, high data rate transmission.

Therefore, it would be desirable to provide a cable capable of high data rate differential signal transmission at higher speeds and longer distances than achieved by existing twin axial cables. This requires having lower differential skew than is achieved by existing twin axial cables.

SUMMARY OF THE INVENTION

Briefly stated, the present invention is directed to a high data rate differential signal transmission cable that has very low skew properties. The high data rate and low skew properties of the present invention is achieved by a unique combination of conductors disposed in parallel combined with particular insulation and shielding materials.

In its basic form, the cable of the present invention comprises a first electrical conductor and a second electrical conductor extending substantially parallel to the first conductor. A crush resistant insulation, preferably foamed fluorinated ethylene propylene copolymer (FEP) insulation, is disposed at least between the first and second conductors, electrically insulating the first conductor from the second conductor. A plurality of electrically conductive strands are interwoven to form a shield surrounding the first conductor, the second conductor, and the insulation. The insulation further electrically insulates the strands from the conductors.

The cable of the present invention is constructed of materials and configured to maintain the first and second conductors in parallel relation over the length of the cable, even when the cable is subjected to the stresses of handling in manufacture, installation, or use. The combination of these elements transmits differential signals that experience remarkably low skew between the first and second conductors. This results in a cable capable of reliably transmitting high speed signals over an extended length. This provides a typical a maximum time delay skew of less than 200 pSec/30 meters, vastly improved over existing twin-axial cable constructions.

In another embodiment of the present invention, the differential cable comprises a first electrical conductor, a second electrical conductor, first and second foamed polymeric insulating dielectrics surrounding the first and second conductors, respectively, and a plurality of electrically conductive strands interwoven to form a shield surrounding the first and second dielectrics. The dielectrics further electrically insulate the strands from the conductors. Again, the cable is constructed of materials and configured to maintain the conductors in substantially parallel relation over the length of the cable. In this manner, in a differential signal transmission, a first electrical signal transmitted by way of the first conductor and a second electrical signal transmitted by way of the second conductor may be maintained 180 degrees out of phase from each other.

The present invention also provides an improved method of transmitting a differential signal by way of a cable. By employing a cable of the present invention having parallel conductors, a crush resistant insulation, and a braided shield surrounding the insulation, differential signals can be reliably transmitted along the cable with a very low maximum time delay skew (e.g., less than 200 pSec/30 meters). This is a dramatically better method of signal propagation than is presently possible employing conventional differential signal transmission methods with existing twin-axial cable constructions.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangement and instrumentality shown. In the drawings.

DETAILED DESCRIPTION OF PREFERRED EMBODIMENTS

Certain terminology is used in the following description for convenience only and is not limiting. The words "inwardly" and "outwardly" refer to directions towards and away from, respectively, the geometric center of the cable and designated parts thereof. The terminology includes the words specifically mentioned, derivatives thereof and words of similar import.

Figure 1:
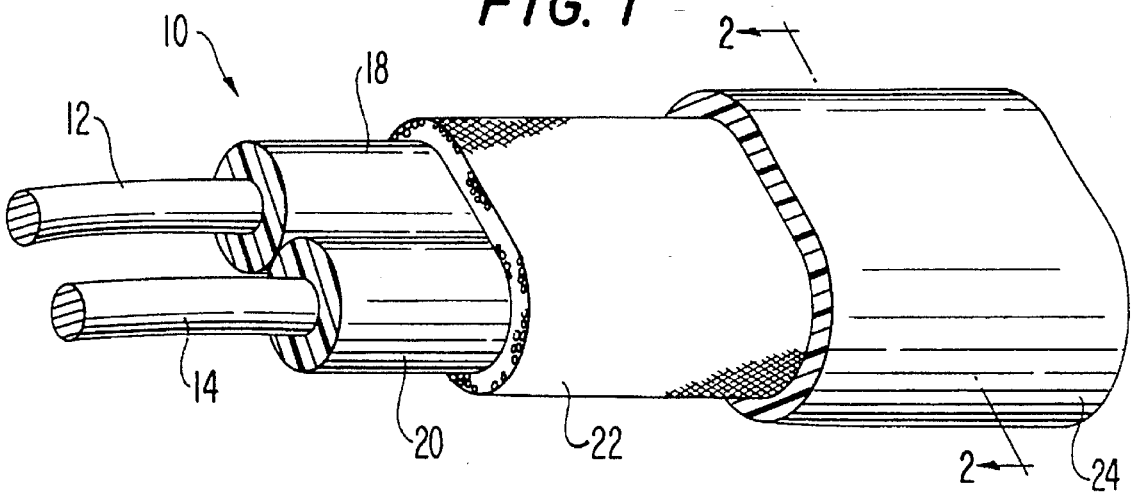
FIG. 1 is an enlarged perspective view of a parallel pair cable in accordance with the present invention.
Figure 2:
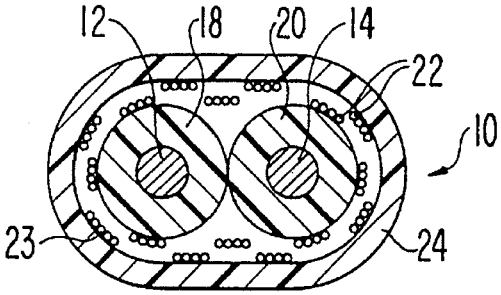
FIG. 2 is a cross-sectional view of the parallel pair cable of FIG. 1, taken along lines 2—2 of FIG. 1.
Figure 3:
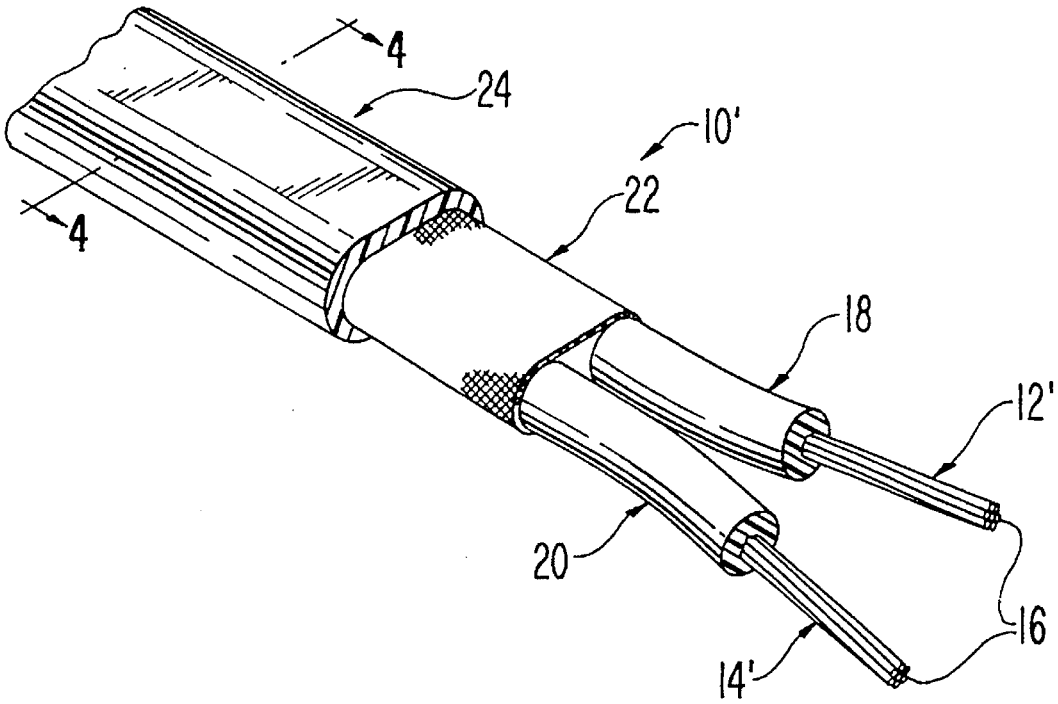
FIG. 3 is a perspective view of a first alternate embodiment of a parallel pair cable in accordance with the present invention.
Figure 4:
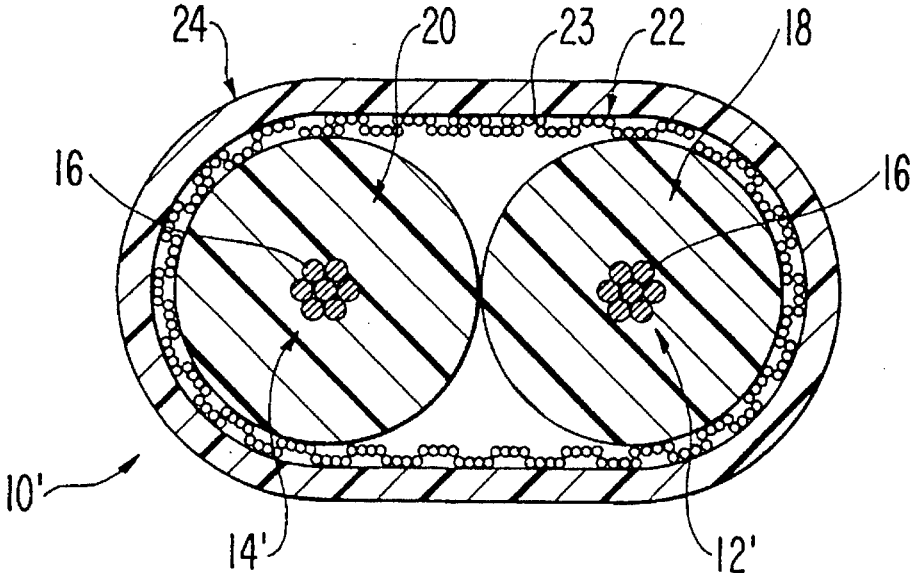
FIG. 4 is an enlarged cross-sectional view of the parallel pair cable of FIG. 3, taken along lines 4—4 of FIG. 3.

Referring now to the drawings in detail, wherein like numerals indicate like elements throughout, there is shown in FIGS. 1 and 2 one embodiment of the present invention comprising a parallel pair or twin axial cable 10 for high data rate differential signal transmission. A first alternate embodiment parallel pair or twin axial cable 10' is shown in FIGS. 3 and 4. Cables 10 and 10' differ in the use of single strand electrical conductors 12 and 14 in cable 10 and multi-strand electrical conductors 12' and 14' in cable 10'. When signals are transmitted by way of the cable 10 or 10' the cable 10 or 10' exhibits very low time delay skew characteristics.

FIG. 1 is an enlarged perspective view of the cable 10. The cable 10 has a first electrical conductor 12 for transmitting a first electrical signal and a second electrical conductor 14 for transmitting a second electrical signal. The second conductor 14 extends in substantially parallel relation with respect to the first conductor 12 along the length of cable 10. The first and second conductors 12, 14 may be constructed of any electrically conductive material, such as copper, copper alloys, metal plated copper, aluminum or steel.

The presently preferred embodiments use copper conductors which are plated with silver to prevent the copper from oxidizing. It is understood by those skilled in the art from this disclosure that other materials or metals could be used to plate the conductors to prevent oxidation, such astin, and that the present invention is not limited to plating the conductors 12, 14 with silver. Each of the conductors 12, 14 may be constructed of either a single, solid strand of conductive material, or may be constructed of a plurality of twisted strands of conductive material, as shown in FIGS. 3–4.

In FIGS. 3 and 4, the conductors 12' 14' comprise a plurality of conductive strands 16 which are preferably tightly twisted or wound together. The conductors 12, 14 of the preferred embodiment of FIGS. 1 and 2 are 24 AWG (American Wire Gauge). The twisted strand conductors 12', 14' preferably comprise seven strands of a gauge such that the twisted strand equals 24 AWG. It is understood by those of ordinary skill in the art from this disclosure that other gauge size conductors could be used, and that more or less than seven conductive strands could be used to form the conductors 12', 14' and that the present invention is not limited to 24 AWG conductors.

The first and second conductors 12, 14 are separated, and electrically insulated at least from each other, by means of insulation disposed between the first and second conductors 12, 14. The insulation is preferably formed from a generally crush resistant material having a low dielectric constant. As shown in FIGS. 1–4, a first insulating dielectric 18 surrounds the first conductor 12 and a second insulating dielectric 20 surrounds the second conductor 14. The dielectrics 18, 20 are generally cylindrical in shape and are generally symmetrical over the length of the cable 10. The second dielectric 20 extends substantially parallel with respect to the first dielectric 18 and is in contact with the first dielectric 18.

An important feature of the dielectrics 18, 20 is that they be sufficiently strong and resilient to prevent collapsing. In the preferred embodiment, the dielectrics 18, 20 are constructed of a material which is sufficiently crush resistant to avoid significant changes in the insulative properties of the dielectrics 18, 20 upon the application of an external force upon the cable 10 during processing or in use. Coaxial and twin axial type cables used in high data rate transmission are generally more susceptible to deformation than other types of wire and cable. Process tensions, squeezing, hitting, or stepping on coaxial or twin axial cable can result in a deformation that changes the impedance and velocity of propagation (electrical properties) of the cable, and consequently, cause a degradation of the carried signal. Variation may also occur in the cables electrical properties due to manufacturing variability associated with the conductor and dielectric. Tight control of the cable electrical parameters are especially important in high data rate signal transmission.

Although many different materials are known and have been used to insulate electrical conductors, it has been found that a foamed amorphous or partially crystalline polymer material meets the criteria of being generally crush resistant and having a low dielectric constant. The insulation dielectrics 18 and 20 are foamed polymers, more desirably, foamed thermoplastics, and most preferably a foamed thermoplastic polymer selected from the group consisting essentially of fluorinated ethylene propylene copolymer (FEP), perfluoroalkoxy copolymer (PFA), ethylene tetrafluoroethylene copolymer (ETFE), polyolefin copolymers, and polyallomer. Alternatively, it may be possible to construct the dielectric from certain non-foamed materials, such as expanded polytetrafluoroethylene polymer (ePTFE), by making such materials sufficiently crush resistant.

The above materials are preferred for dielectrics because they can be characterized as having a low value of permitivity or dielectric constant (generally 2.5 or less), extremely low losses, excellent temperature stability and are resistive to chemical degradation. For instance, the dielectric constant of foamed FEP is 1.5, and its operating temperature range is from −50° C. to +200° C. Moreover, these materials are sufficiently crush resistant to maintain the conductors 12, 14 at a generally constant distance apart from each other and away from a shield 22 which surrounds the dielectrics 18, 20 over the length of the cable 10. This is a very important feature because the impedance of the cable 10 is related to the diameter of the conductors 12, 14, and the spacing between the conductors 12, 14. By providing a dielectric 18, 20 with a low dielectric constant, the dielectric 18, 20 can have a smaller diameter for a given impedence, which allows for a smaller size and lighter weight cable 10.

The most preferred dielectric for use with the present invention comprises a foamed FEP. While, polyethylene foams are commonly used in industry today, FEP foams have distinct advantages over polyethylene in regards to resistance to deformation at high temperature and in being able to meet UL requirements for flame retardancy and smoke generation for use in plenum applications. Resins used in these applications are typically loaded with a nucleating agent to assist in the formation of small uniform cells through the thickness of the insulation. In fluoropolymers such as FEP, the typical nucleating agent is boron nitride. However, alternate systems for nucleation can be used as are described in U.S. Pat. No. 4,764,538, 5,032,621, and 5,023,279, each incorporated by reference.

When considering processability, physical properties, and economics, TEFLON® FEP CX 5010, available from E. I. dupont de Nemours and Company, Wilmington, Del., has been found to offer the best compromise satisfying all of these considerations. The equipment used for processing these resins is known and is generally described below.

Continuous foaming of FEP, PFA, or ETFE resin can be achieved by using a blowing agent (e.g., FREON 22 fluoromethane gas available from E. I. dupont de Nemours and Company, or, where environmental concerns are raised, nitrogen gas) and an extruder. Suitable polymers for use in this process include FEP 100, PFA 340, CX5010 polymers, and others, all available from E. I. dupont de Nemours and Company. Foaming of the insulation material should be carried out in accordance with the polymer manufacturer's instructions. The following is an outline of suitable procedures for the above listed preferred polymers acquired from E. I. dupont de Nemours and Company.

The blowing agent is dissolved in the resin to equilibrium concentrations, such as by injection in a screw extruder. By adjusting the pressure in the extruder, the amount of blowing agent dissolved in the melt can be controlled. The greater the amount of blowing agent dissolved in the melt, the greater the final void volume of the foam. One preferred method of blowing comprises high pressure nitrogen injection, such as that taught in U.S. Pat. No. 3,975,473, incorporated by reference, but employing a multiple-stage screw described herein.

For use in the present invention, a single screw extruder, such as that available from Entwistle Company, Hudson, MA, provided with a medium size screw (e.g., 1.25), should be suitable. Preferably a "super shear" extrusion process should be used to maximize throughput. Ideally, a five zone extruder should be employed to provide uniform blowing agent dispersion. Other preferred operating parameters include: using a fixed centered crosshead; providing careful temperature and motor control; and employing smooth, streamlined tooling (both tip and die); and using high nickel alloy crosshead components. The tip and die size should be appropriately selected for wire and wall thickness. A vacuum should be applied from the rear of the crosshead to pull the insulation tightly onto the conductor.

Foam formation begins as the molten resin passes out of the extrusion die. The blowing agent dissolved in the polymer resin comes out of the resin as a result of sudden pressure drop as the extrudate exits the extrusion die. Foam growth ceases upon cooling, such as when the extrudate enters a water cooling trough. To produce uniform, small diameter cell structure, a nucleating agent may be employed, such as boron nitride. A 0.5% by weight loading of boron nitride should provide adequate foam cell nucleation. This level of nucleating agent loading can be achieved by blending a cube concentrate resin FEP or PFA containing 5% boron nitride with virgin, unfilled resin. A cube blend of 1 part concentrate to 9 parts unfilled resin will approximate the 0.5% loading. Concentrate resins are commercially available in this form. However, superior results may be obtained by using resin with pre-dispersed nucleating agent, such as TEFLON FEP CX5010.

The amount of foaming which occurs exiting the extruder is a function of the temperature of the crosshead and should be carefully controlled. Additionally, capacitance and the diameter of the insulation should likewise be continuously monitored as it exits the extruder to assure uniformity.

Once a foamed insulation is applied to a conductor in the manner described above, the wire may then be incorporated into a cable of the present invention.

The dielectrics 18, 20 may be installed around the conductors 12, 14, respectively, through any suitable means. Preferably the insulative layer is foamed by blowing nitrogen into the dielectric during an extrusion process. The dielectrics 18, 20 are on the order of 0.105 inches in diameter. Other possible suitable methods of positioning the dielectrics 18, 20 around the conductors 12, 14 include wrapping insulation or coextruding the insulative layer.

The present invention further comprises a metal shield 22 which surrounds the dielectrics 18, 20. The metal shield is preferably constructed of a plurality of interwoven, electrically conductive strands 23 (FIGS. 2 and 4) which surround the conductors 12, 14, and the insulation dielectrics 18, 20. The strands 23 of the shield 22 are electrically insulated from the conductors 12, 14 by the dielectrics 18, 20. The shield 22 functions to confine the radiated energy to the bounds of a specific volume, and prevent radiated radiated energy from escaping the cable construction. The Federal Communications Commission (FCC) has set limits as to how much energy is permitted to be radiated from a cable or wire.

Some of the considerations used in selecting the shield type of the present invention are the amount of reflective loss desired for the electric field, electrochemical corrosion resistance, mechanical strength, and electrical conductivity. The shield 22 is preferably constructed of tin or silver plated copper strands. The shield 22 is constructed of a bare or conductively plated copper because copper is a good conductor, and provides high reflective loss. The strands of the shield 22 are interwoven such that openings and discontinuities in the surface of the shield 22 are maintained at a desired minimum amount. For instance, the shield 22 can be interwoven to provide 85% coverage, or can be interwoven or braided to provide up to 100% coverage. Both high coverage (100%) and lower coverage braids can be used. The preferred embodiment of the cable 10 uses a braided shield of 38 AWG strands. The strands may be braided in a one over and one under manner to form the shield 22.

Existing cables use an helically wrapped aluminized MYLAR® or other polyester foil shield and a drain wire to drain off the current on the shield. This type of shield has been found to perform poorly in comparison to the high-speed data transmissions which the cables 10 and 10' of the present invention are capable. Additionally, other known shielding methods, such as served wire shields, have been found not to perform as well as the braided metal shield 22 of the present invention.

Although interwoven or braided shields are known, they have not been used in combination with a foamed fluoropolymer dielectric in constructing parallel pair cables for achieving low skew. Some of the reasons discouraging such a combination have been cost, space considerations, manufacturing time, and the belief that other shielding methods, such as helically wrapped polyester foil, provided a cable with better performance characteristics for high frequency transmissions. However, it has been found that braiding works surprisingly well in maintaining uniformity between the two conductors 12, 14 and, particularly with the foamed fluorocarbon based polymer insulation provides superior transmission characteristics.

An outer jacket 24 is preferably placed around and surrounds the shield 22, the dielectrics, 18, 20 and the conductors, 12, 14 and is useful for electrically insulating the shield 22, preventing contamination of the shield 22, and inhibiting breakdown of the dielectrics 18, 20. The jacket 24 can also serve as a surface for marking or coding the cable 10.

The jacket 24 may be constructed of polyvinylchloride (PVC), PVC compounds, FEP, or similar polymers. These materials are preferred because of their environmental and electrical properties. These materials are inherently flame retardant and do not contribute to flame propagation. Moreover, they have high dielectric strength and insulation resistance, and operate in the temperature range from −55° C. to +105° C. for PVC and 200° C. for FEP. Additionally, these materials have relatively high tensile strengths, good abrasion resistances, and can withstand exposure to the environment and corrosive chemicals. Moreover, they are relatively inexpensive and easy to process. Preferably, jacket 24 is between about 0.010 and 0.015 inches thick. The jacket 24 may be extruded over or otherwise positioned around the shield 22.

Cables 10 and 10' are constructed of materials and configured to maintain the first and second conductors 12, 14 and 12', 14' in substantially parallel relation over the length of the cables 10, 10'. The foamed polymer dielectric insulation and the braided metal shield provide for improved mechanical strength and electrical performance and ensure that the characteristic impedance of the cable 10 remains substantially constant over the length of the cable 10. The cable electrical characteristics are improved by the combination of materials used in the cable 10, providing significantly decreased time delay skew.

A typical parallel pair cable has specifications in the range of 0.15 dB/ft attenuation at 100 Mhz., a nominal time delay of 1.24 nSec/ft and a time delay skew between lines of greater than 0.01 nSec/ft (984 psec30 meters). In contrast, a parallel pair cable of the present invention can achieve at least the same attenuation with a time delay skew between lines of only 200 pSec/30 meters or less.

In use, a first electrical data signal is transmitted by way of the first conductor 12. A second electrical data signal is then transmitted by way of the second conductor 14 180 degrees out of phase from the first electrical signal. The time delay skew between the first and the second signal is minimized due to the construction and configuration of the cable 10 or 10' such that the second signal is substantially maintained 180 degrees out of phase from the first electrical signal over the length of the cable 10 or 10'. The cables 10 and 10' are capable of transmitting a differential signal at a data rate of 1000 Mbps for distances greater than 30 meters.

Figure 6:
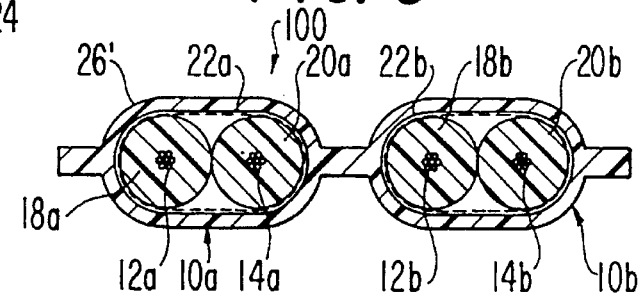
FIG. 6 is a cross-sectional view of the two parallel pair cable of FIG. 5, taken along lines 6—6 of FIG. 5.
Figure 5:
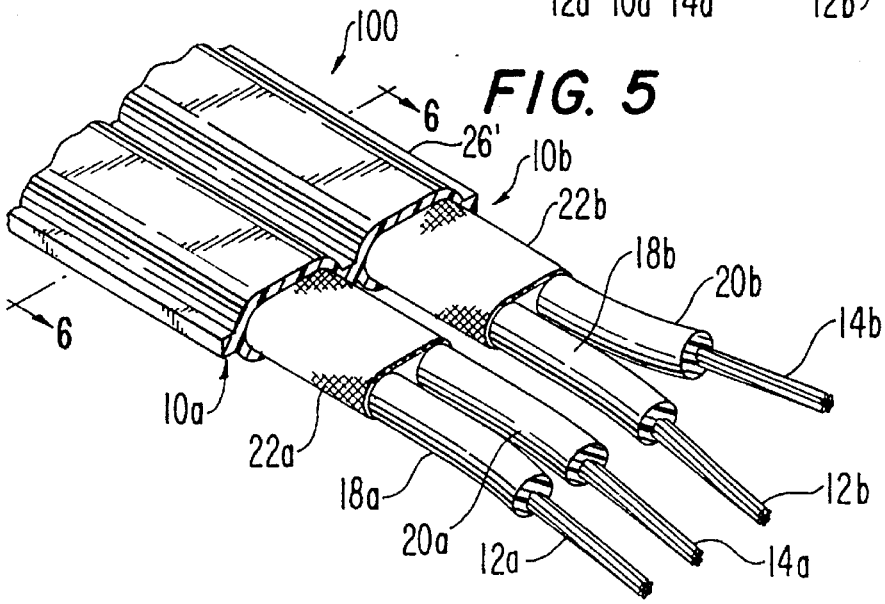
FIG. 5 is a perspective view of a two parallel pair cables in accordance with the present invention.

Referring now to FIGS. 5 and 6, there is a cable 100 having two parallel pair component cables **10*a*, 10*b* of the present invention and a jacket 26' which integrally connects the two parallel pair component cables 10*a*, 10*b*. Each component cable 10*a*, 10*b* has a first conductor 12*a*/12*b* for transmitting a first electrical signal and a second conductor 14*a*/14*b* for transmitting a second electrical signal. The second conductor 14*a*/14*b* extends substantially parallel with respect to the first conductor 12*a*/12*b*, respectively. The first and second conductors 12*a*/12*b* and 14*a*/14*b* are preferably constructed of silver plated copper, as previously described for cables 10 and 10'. Each of the conductors 12*a*/12*b*, 14*a*/14*b* may be constructed of either a single, solid strand of conductive material like cable 10, or may be constructed of a plurality of twisted strands of conductive material, as shown, like cable 10'. The conductors 12***a*/12*b*, 14*a*/14*b* are preferably 24 AWG, formed by twisting seven strands of a gauge size which collectively equal 24 AWG.

The first and second conductors 12*a*/12*b*, 14*a*/14*b* or each component cable 10*a*/10*b* are separated, and electrically insulated from each other, respectively by means of insulation disposed between the first and second conductors 12*a*/12*b*, 14*a*/14*b*. The insulation is formed from a generally crush resistant material having a low dielectric constant. A first insulation dielectric 18*a*/18*b* surrounds the first conductors 12*a*/12*b* of each cable 10*a*/10*b* and a second insulation dielectric 20*a*20*b* surrounds the second conductor 14*a*/14*b*. The insulation dielectrics 18*a*/18*b*, 20*a*20*b* are generally cylindrical in shape and are generally symmetrical over the length of the cable 30. The second dielectric 20*a*20*b* extends substantially parallel with respect to the first dielectric 18*a*/18*b* in each component cable 10*a*/10*b* and is in contact with the first dielectric 18*a*/18*b*. An important feature of the dielectrics 18*a*/18*b*, 20*a*/20*b* is that they be sufficiently strong to prevent collapsing. As with the cable 10 previously described, the dielectrics 18*a*/18*b*, 20*a*/20*b* are constructed of a material, preferably a foamed FEP or similar fluoropolymer, which is sufficiently crush resistant to avoid significant changes in the insulative properties of the dielectrics 18*a*/18*b*, 20*a*/20*b* upon the application of an external force upon the cable 30.

Metal shields 22*a* and 22*b* surround the dielectrics 18*a*/18*b* and 20*a*/20*b* of each of the component cables 10a and 10*b*, respectively As for the cables 10 and 10' each of the metal shields 22*a* and 22*b* is constructed of a plurality of interwoven, electrically conductive strands. The strands of each of the shields 22*a* and 22*b* are electrically insulated from the conductors 12*a*/14*a* and 12*b*/14*b*, respectively of each component cable 10*a* and 10*b*.

The shields 22*a* and 22*b* are also electrically insulated and physically separated from each other preferably by an outer jacket 26 which surrounds each of the component cables 10*a*/10*b* and integrally connects the component cables 10*a*/10*b* together. As with cables 10 and 10' the jacket 26 may be constructed from PVC The cable 100 is useful when full duplex differential signal transmission is desired. A first data signal may be transmitted on the first pair of conductors 12*a*/14*a* in a first direction, and a second data signal may be transmitted on the second pair of conductors 12*b*/14*b* in a second direction, which is opposite the first direction. Thus, if the cable 100 links a host processor to a memory storage unit, the processor may transmit data to the storage unit on the first pair of conductors 12*a*/14*a*, and the storage unit may simultaneously transmit data to the processor on the second pair of conductors 12*b*/14*b*.

Although parallel pair cables are known and have been used for many years, no known parallel pair cables have used the unique combination used in the present invention. The preferred embodiments of the present invention combine silver plated copper electrical conductors, each preferably surrounded by a foamed fluoropolymer insulator, a braided metal shield surrounding each pair of conductors and their respective insulators, and an outer jacket surrounding the shield or shields. This combination has been found to yield surprisingly good results for long distance, high-speed differential signal transmission in that the cables 10 and 10' exhibit very low time delay skew Characteristics. Previous parallel pair cables generally transmit data at speeds on the order of 500 Mbps and have a time delay skew on the order of 32.8 pSec/m, whereas the cables 10 and 10' of the present invention are capable of transmitting at speeds on the order of 1000 Mbps with a time delay skew of less than 6.56 psec/m.

From the foregoing description, it can be seen that the preferred embodiment of the invention comprises a cable for use in transmitting signals at high data rates between two points. The cable 10 exhibits excellent data rate and very low skew characteristics, so that signals transmitted by way of the cable are not overly skewed even when transmitted over long distances or when the cable 10 is subjected to bending or twisting. Further, the cables can be easily and efficiently manufactured.

It will be appreciated that changes and modifications may be made to the above described embodiments without departing from the inventive concept thereof. Therefore, it is understood that the present invention is not limited to the particular embodiment disclosed, but is intended to include all modifications and changes which are within the scope and spirit of the invention as defined by the appended claims.

We claim:

1. A high speed data transmission cable having a length comprising:

a first electrical conductor;

a second electrical conductor, said second conductor extending substantially parallel with respect to said first conductor;

insulation disposed at least between said first and second conductors at least electrically insulating said first conductor from said second conductor, said insulation comprising a foamed polymer; and a plurality of electrically conductive strands interwoven to form a shield surrounding said first conductor, said second conductor and said insulation, said insulation further electrically insulating said strands from said conductors;

wherein the cable is constructed of materials and configured to maintain said first and second conductors in substantially parallel relation over the length of the cable; and wherein differential signals transmitted by way of said first and second conductors experience low skew between said first and second conductors.

2. The apparatus of claim 1 wherein said insulation comprises first and second insulating dielectrics surrounding said first and second conductors, respectively.

3. The apparatus of claim 2 wherein said second dielectric extends substantially parallel with respect to said first dielectric and is in contact with said first dielectric.

4. The apparatus of claim 3 wherein said dielectrics are constructed of a material which is sufficiently crush resistant to avoid significant changes in insulative properties of said dielectrics upon the application of tensions and forces associated with handling the cable.

5. The apparatus of claim 1 wherein the foamed polymer is a thermoplastic.

6. The apparatus of claim 1 wherein the foamed polymer is selected from the group consisting essentially of fluodnated ethylene propylene copolymer, perfluoroalkoxy tetrafluoroethylene copolymer, ethylene tetrafluoroethylene copolymer, polyolefin copolymers, and polyallomer.

7. The apparatus of claim 1 wherein said conductors are constructed of silver plated copper.

8. The apparatus of claim 1 wherein each of said conductors comprises a plurality of strands.

9. The apparatus of claim 1 further comprising an insulating outer jacket surrounding the shield.

10. The apparatus of claim 1 wherein the strands of the shield are constructed of tin plated copper.

11. The apparatus of claim 1 wherein the strands of the shield are constructed of silver plated copper.

12. A differential cable for high speed data transmission, the cable having a length, the cable comprising:

a first electrical conductor for transmitting a first electrical signal;

a second electrical conductor in substantially parallel relation to the first electrical conductor over the length of the cable, for transmitting a second electrical signal;

first and second foamed polymeric insulating dielectrics surrounding said first and second conductors, respectively;

a plurality of electrically conductive strands interwoven to form a shield surrounding said first and second dielectrics, the strands being electrically insulated from said conductors;

said second electrical signal being 180 degrees out of phase from said first electrical signal, and having a maximum time delay skew of less than 200 pSec/30 meters with respect to said first electrical signal.

13. A method of transmitting a differential signal by way of a cable, comprising the steps of:

providing a cable having a length, two conductors in substantially parallel relationship insulated from each other with a dielectric, and a plurality of interwoven electrically conductive strands surrounding the dielectric as a shield, wherein the two conductors are insulated from each other and from the strands;

transmitting a first electrical data signal by way of one of the conductors; and transmitting a second electrical data signal by way of the other conductor which is 180 degrees out of phase from said first electrical signal, with a time delay skew of less than 200 pSec/30 meters between said first and said second signals being maintained over the length of the cable.

14. The method of claim 13 which further comprises providing a dielectric comprising a foamed fluorinated ethylene propylene (FEP).

15. The method of claim 14 which further comprises providing a first and a second insulating dielectrics surrounding said first and second conductors, respectively, and in direct contact with the shield.

16. The method of claim 15 which further comprises maintaining the two conductors in substantially identical spacial relation between each other and the shield over the length of the cable.

17. The method of claim 16 further comprising providing an insulating outer jacket surrounding the shield.

18. The method of claim 13 wherein each of said conductors comprises a plurality of strands.

19. The method of claim 13 further comprising providing an insulating outer jacket surrounding the shield.

20. A high speed data transmission cable having a length comprising:

a first electrical conductor;

a second electrical conductor, said second conductor extending substantially parallel with respect to said first conductor;

insulation comprising first and second insulating dielectrics surrounding said first and second conductors, respectively, said second dielectric extending substantially parallel with respect to said first dielectric and in contact therewith, said insulation comprising a foamed polymer material which is sufficiently crush resistant to avoid significant changes in the insulative properties of said dielectrics upon the application of tensions and forces associated with handling the cable;

a plurality of electrically conductive strands interwoven to form a shield surrounding said first conductor, said second conductor and said insulation, said insulation further electrically insulating said strands from said conductors;

wherein the cable is constructed of materials and configured to maintain said first and second conductors in substantially parallel relation over the length of the cable; and wherein differential signals transmitted by way of said first and second conductors expedence low skew between said first and second conductors.

21. The apparatus of claim 20 wherein the foamed polymer is a thermoplastic.

22. The apparatus of claim 20 wherein the foamed polymer is selected from the group consisting essentially of fluodnated ethylene propylene copolymer, perfluoroalkoxy tetrafluoroethylene copolymer, ethylene tetrafluoroethylene copolymer, polyolefin copolymers, and polyallomer.

23. A high speed data transmission cable having a length comprising:

a first electrical conductor;

a second electrical conductor, said second conductor extending substantially parallel with respect to said first conductor, said first and second conductors comprising silver plated copper;

insulation disposed at least between said first and second conductors at least electrically insulating said first conductor from said second conductor; and a plurality of electrically conductive strands interwoven to form a shield surrounding said first conductor, said second conductor and said insulation, said insulation further electrically insulating said strands from said conductors;

wherein the cable is constructed of materials and configured to maintain said first and second conductors in substantially parallel relation over the length of the cable; and wherein differential signals transmitted by way of said first and second conductors experience low skew between said first and second conductors.

24. A high speed data transmission cable having a length comprising:

a first electrical conductor;

a second electrical conductor, said second conductor extending substantially parallel with respect to said first conductor, said first and second conductors comprising a plurality of strands;

insulation disposed at least between said first and second conductors at least electrically insulating said first conductor from said second conductor; and a plurality of electrically conductive strands interwoven to form a shield surrounding said first conductor, said second conductor and said insulation, said insulation further electrically insulating said strands from said conductors;

wherein the cable is constructed of materials and configured to maintain said first and second conductors in substantially parallel relation over the length of the cable; and wherein differential signals transmitted by way of said first and second conductors experience low skew between said first and second conductors.

25. A high speed data transmission cable having a length comprising:

a first electrical conductor;

a second electrical conductor, said second conductor extending substantially parallel with respect to said first conductor;

insulation disposed at least between said first and second conductors at least electrically insulating said first conductor from said second conductor; and a plurality of electrically conductive strands interwoven to form a shield surrounding said first conductor, said second conductor and said insulation, wherein said strands of the shield are constructed of silver plated copper, said insulation further electrically insulating said strands from said conductors;

wherein the cable is constructed of materials and configured to maintain said first and second conductors in substantially parallel relation over the length of the cable; and wherein differential signals transmitted by way of said first and second conductors experience low skew between said first and second conductors.

26. A method of transmitting a differential signal by way of a cable, comprising the steps of:

providing a cable having a length, two conductors in substantially parallel relationship insulated from each other with a foamed polymer dielectric, and a conductive shield surrounding the dielectric as a shield, wherein the two conductors are insulated from each other and from the conductive shield;

transmitting a first electrical data signal by way of one of the conductors; and transmitting a second electrical data signal by way of the other conductor which is 180 degrees out of phase from said first electrical signal.

* * * * *